US011377314B2

(12) United States Patent
Ikeda et al.

(10) Patent No.: US 11,377,314 B2
(45) Date of Patent: Jul. 5, 2022

(54) SHEET CONTAINER, SHEET FEEDER, AND IMAGE FORMING SYSTEM

(71) Applicant: FUJIFILM Business Innovation Corp., Tokyo (JP)

(72) Inventors: Masashi Ikeda, Kanagawa (JP); Masahito Niwa, Kanagawa (JP); Shoichi Maeda, Kanagawa (JP); Kiyoshi Watanabe, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 51 days.

(21) Appl. No.: 16/872,376

(22) Filed: May 12, 2020

(65) Prior Publication Data

US 2021/0061592 A1 Mar. 4, 2021

(30) Foreign Application Priority Data

Sep. 2, 2019 (JP) ..... JP2019-159438

(51) Int. Cl.

| | |
|---|---|
| ***B65H 1/04*** | (2006.01) |
| ***B65H 31/08*** | (2006.01) |
| ***B65H 31/02*** | (2006.01) |
| ***B65H 1/26*** | (2006.01) |

(52) U.S. Cl.

CPC ..... *B65H 1/04* (2013.01); *B65H 1/266* (2013.01); *B65H 31/02* (2013.01); *B65H 31/08* (2013.01); *B65H 2405/115* (2013.01); *B65H 2405/1122* (2013.01); *B65H 2405/1144* (2013.01); *B65H 2405/11161* (2013.01); *B65H 2405/11425* (2013.01); *B65H 2511/11* (2013.01)

(58) Field of Classification Search

CPC ... B65H 1/00; B65H 1/04; B65H 1/26; B65H 1/263; B65H 1/266; B65H 2405/1116; B65H 2405/11164; B65H 2405/112; B65H 2405/1122; B65H 2405/1124; B65H 2402/10; B65H 2511/11; B65H 2405/11161

See application file for complete search history.

(56) References Cited

U.S. PATENT DOCUMENTS

| | | | | |
|---|---|---|---|---|
| 8,480,073 | B1 * | 7/2013 | Ishikawa | B65H 1/14 271/18.2 |
| 9,359,157 | B2 | 6/2016 | Niikura et al. | |
| 2011/0101603 | A1 * | 5/2011 | Bauer | B65H 1/14 271/265.01 |

(Continued)

FOREIGN PATENT DOCUMENTS

| | | |
|---|---|---|
| JP | 2016000653 | 1/2016 |

*Primary Examiner* — Prasad V Gokhale
(74) *Attorney, Agent, or Firm* — JCIPRNET

(57) ABSTRACT

A sheet container includes a housing, a stacking part provided in the housing so that recording sheets are stacked on the stacking part, a contact part to be brought into contact with edges of the recording sheets in a length direction on the stacking part in an attached state in which the contact part is attached into the housing, a connection member connected to the stacking part or the housing and having an extension part longer than the stacking part in the length direction, and a retreater that retreats the contact part in the attached state from the extension part with the connection member connected to the stacking part or the housing.

19 Claims, 12 Drawing Sheets

(56) References Cited

U.S. PATENT DOCUMENTS

| | | | | |
|---|---|---|---|---|
| 2016/0016740 | A1* | 1/2016 | Niikura | B65H 1/266<br>271/171 |
| 2016/0185556 | A1* | 6/2016 | Ito | B65H 31/02<br>271/220 |

* cited by examiner

SHEET CONTAINER, SHEET FEEDER, AND IMAGE FORMING SYSTEM

CROSS-REFERENCE TO RELATED APPLICATIONS

This application is based on and claims priority under 35 USC 119 from Japanese Patent Application No. 2019-159438 filed Sep. 2, 2019.

BACKGROUND

(i) Technical Field

The present disclosure relates to a sheet container, a sheet feeder, and an image forming system.

(ii) Related Art

Japanese Unexamined Patent Application Publication No. 2016-000653 describes a sheet feeder and an image forming apparatus in which damage to an extension part may be prevented.

SUMMARY

Aspects of non-limiting embodiments of the present disclosure relate to a sheet container in which a connection member for long sheets may be connected while keeping an attached state of a contact part for non-long sheets.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet container comprising a housing, a stacking part provided in the housing so that recording sheets are stacked on the stacking part, a contact part to be brought into contact with edges of the recording sheets in a length direction on the stacking part in an attached state in which the contact part is attached into the housing, a connection member connected to the stacking part or the housing and having an extension part longer than the stacking part in the length direction, and a retreater that retreats the contact part in the attached state from the extension part with the connection member connected to the stacking part or the housing.

BRIEF DESCRIPTION OF THE DRAWINGS

An exemplary embodiment of the present disclosure will be described in detail based on the following figures, wherein.

DETAILED DESCRIPTION

Figure 1:
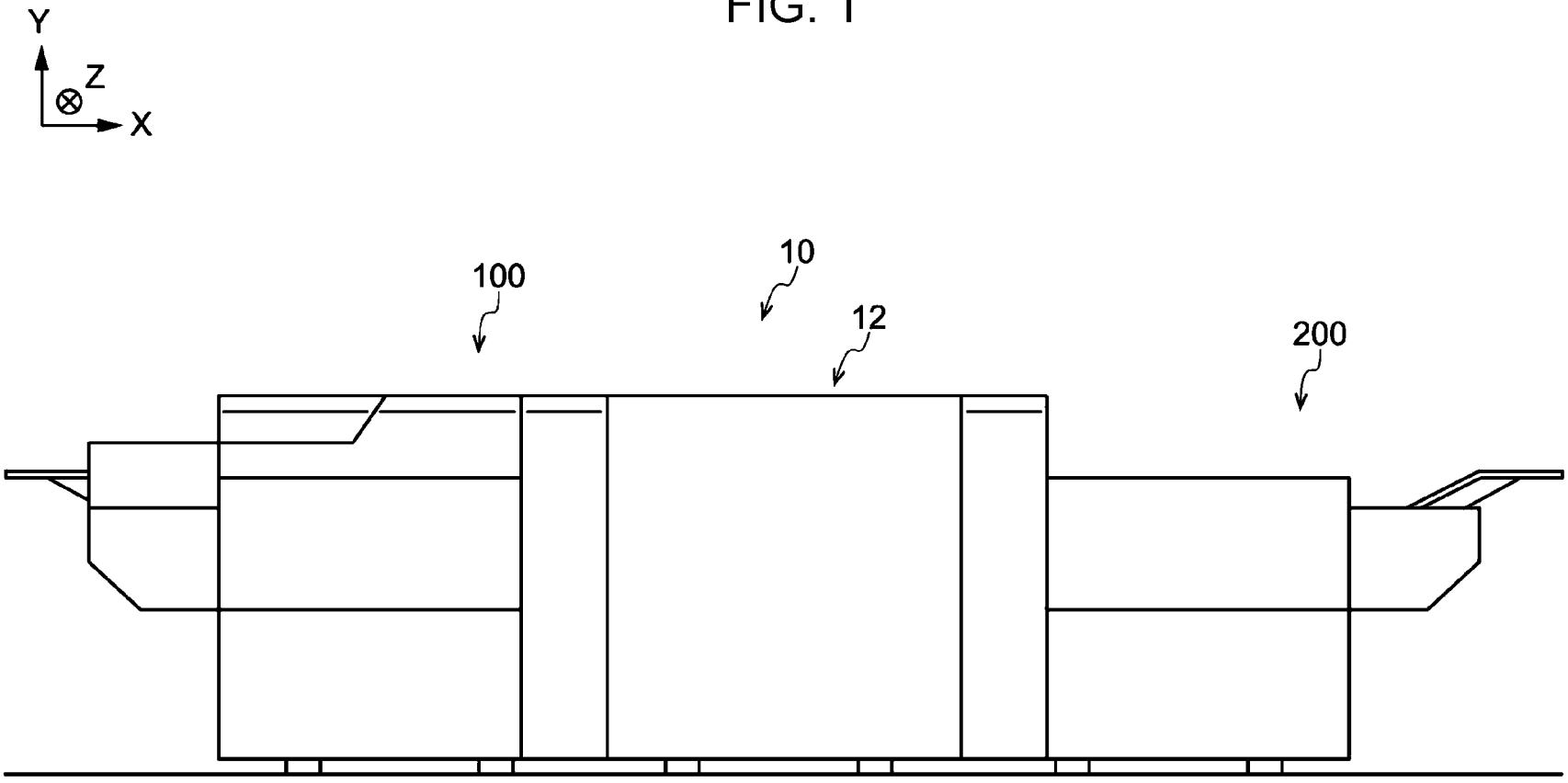
FIG. 1 is a front view illustrating an image forming system including a sheet feeder and a sheet container according to an exemplary embodiment.

An exemplary embodiment of the present disclosure is described below. In the following description, a direction indicated by an arrow X in the drawings is a width direction and a direction indicated by an arrow Y in the drawings is a height direction. A direction orthogonal to the width direction and the height direction (direction indicated by an arrow Z) is a depth direction.

<Structure of Image Forming System>

An image forming system 10 according to the exemplary embodiment forms images on sheets P that are examples of a recording sheet. As illustrated in FIG. 1, the image forming system 10 includes an image forming apparatus 12, a sheet feeder 100, and a sheet container 200. The image forming apparatus 12 forms images on the sheets P. The sheet feeder 100 transports the sheets P to the image forming apparatus 12. The sheet container 200 contains the sheets P having images formed by the image forming apparatus 12 and output from the image forming apparatus 12. The image forming apparatus 12 is an electrophotographic image forming apparatus including an image former that forms images on recording media, and a transporter that transports the sheets P to the image former. The sheet feeder 100 adjoins the image forming apparatus 12. The sheet container 200 adjoins the image forming apparatus 12 opposite the sheet feeder 100. The sheet feeder 100 and the sheet container 200 are attached to the image forming apparatus 12 as its options and are put into market individually. The image former of the image forming apparatus 12 is not limited to the one employing the electrophotographic system. The image former may employ various other systems such as an ink jet system, a relief printing system, a planographic printing system, or an intaglio printing system.

[Structure of Sheet Feeder]

Figure 4:
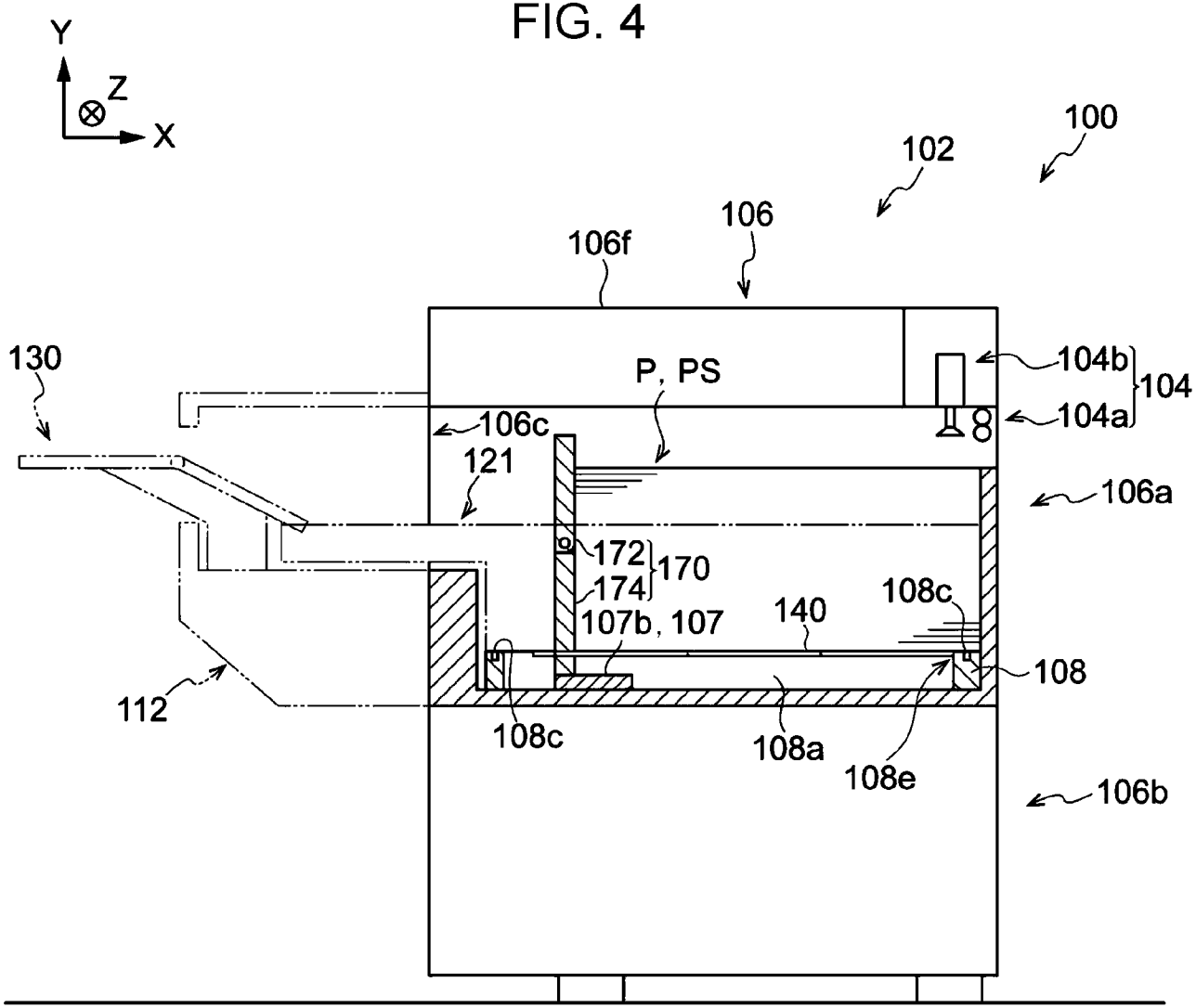
FIG. 4 is a front sectional view illustrating the sheet feeder in which a long-sheet option is not connected and non-long sheets are stacked on a stacking plate according to the exemplary embodiment.

As illustrated in FIG. 4, the sheet feeder 100 includes a sheet container 102 that contains the sheets P to be transported to the image forming apparatus 12, and transporters 104 that transport the sheets P to the image forming apparatus 12. In this exemplary embodiment, the transporter 104 includes a transport roller pair 104*a* and a separator 104*b* and is arranged in a housing 106 described later. The transporter 104 transports each sheet P to the image forming apparatus 12 in such a manner that the separator 104*b* separates one sheet P from the stacked sheets P and the transport roller pair 104*a* nips and transports the separated sheet P toward the image forming apparatus 12. The structure of the transporter 104 of the sheet feeder 100 is not limited to the structure described above.

[Structure of Sheet Container 102]

Next, the structure of the sheet container 102 is described. As illustrated in FIG. 4, the sheet container 102 includes the housing 106, an upper tray 106*a*, and a lower tray 106*b*. The housing 106 has a rectangular parallelepiped shape and extends in the height direction. The upper tray 106*a* and the lower tray 106*b* are provided in the housing 106 and are drawable toward a user. The upper tray 106*a* and the lower tray 106*b* contain non-long sheets PS. The non-long sheet PS is one type of sheet P having a length of 488 [mm] or smaller.

The sheet container 102 may contain long sheets PL by attaching an extension option 110 to the upper tray 106*a*. The long sheet PL is one type of sheet P longer than the non-long sheet PS. Description is made first about the sheet container 102 without the extension option 110, and then about the sheet container 102 with the extension option 110.

(Sheet Container without Extension Option)

Referring to FIG. 4, description is made about the sheet container 102 without the extension option 110.

As illustrated in FIG. 4, the upper tray 106*a* includes a stacking plate 108, an end guide 170, slide mechanisms 107, a shutter 140, and side shutters 150 (not illustrated).

(Stacking Plate 108)

The stacking plate 108 is an example of a stacking part where the non-long sheets PS are stacked, and is a rectangular plate arranged at the bottom of the upper tray 106*a*. The stacking plate 108 may ascend or descend relative to the bottom of the upper tray 106*a* by using a lift (not illustrated). Examples of the lift include a wire lift that raises the stacking plate 108 by being coupled to a hoisting mechanism to hoist four wires fixed to four corners of the stacking plate 108, and lowers the stacking plate 108 by gravity by being decoupled from the hoisting mechanism.

The stacking plate 108 has rectangular side cavities (not illustrated) formed on both sides in the depth direction and extending in the height direction. The stacking plate 108 has a rectangular cavity 108*a* formed between the two side cavities and extending in the height direction. As illustrated in FIG. 4, the stacking plate 108 has a plurality of threaded holes 108*c* at the top. A first extension member 120 described later is connected to the stacking plate 108 with screws driven into the threaded holes 108*c*. In the exemplary embodiment of the present disclosure, the threaded hole 108*c* is an example of a connector to which a connection member is connected in a removable manner, and is also an example of a receptacle to which a raising member is attached in a removable manner.

The stacking plate 108 has an opening 108*e* at the top of the cavity 108*a*. The cavity 108*a* allows the end guide 170 to move in the width direction by the slide mechanisms 107 described later.

The stacking plate 108 has placement parts 108*d* (not illustrated) in the cavity 108*a* so that the shutter 140 described later may be placed. The stacking plate 108 also has placement parts (not illustrated) at the top of each side cavity on both sides in the depth direction so that the side shutter 150 described later may be placed over the side cavity.

(End Guide)

As illustrated in FIG. 4, the end guide 170 is a rectangular parallelepiped member provided in the cavity 108*a* of the stacking plate 108 at the bottom of the upper tray 106*a* and extending in the height direction. The end guide 170 is an example of a contact part to be brought into contact with the edges of the sheets P on the stacking plate 108 opposite the image forming apparatus 12. The end guide 170 suppresses movement of the sheets P away from the image forming apparatus 12. The height of the end guide 170 is set so that its upper end is located above the uppermost non-long sheet PS on the stacking plate 108.

(Slide Mechanism)

As illustrated in FIG. 4, the slide mechanisms 107 are provided at the bottom of the upper tray 106*a* and support the end guide 170 so that the end guide 170 is movable in the width direction. Each slide mechanism 107 includes a rail 107*a* (not illustrated) and a slider 107*b*. The rail 107*a* is fixed to the bottom of the upper tray 106*a* and extends in the width direction. The slider 107*b* is fixed to the lower end of the end guide 170 and attached to the rail 107*a* in a slidable manner. The slide mechanism 107 is an example of a keeper that keeps an attached state in which the end guide 170 is attached to the housing 106.

(Shutter)

As illustrated in FIG. 4, the shutter 140 is arranged in a removable manner on the placement parts 108*d* (not illustrated) over the cavity 108*a* of the stacking plate 108. The shutter 140 extends or contracts in the width direction when the end guide 170 extending in the height direction is moved in the width direction by the slide mechanism 107, thereby closing a part of the opening 108*e* near the image forming apparatus 12 with respect to the end guide 170.

(Side Shutter)

Each side shutter 150 is arranged in a removable manner on the placement parts over the side cavity of the stacking plate 108 and closes the side cavity.

When the shutter 140 and the side shutters 150 are arranged on the stacking plate 108, the sheets P on the stacking plate 108 are supported by the stacking plate 108, the shutter 140, and the side shutters 150 as illustrated in FIG. 4.

(Lower Tray)

The lower tray 106*b* is arranged below the upper tray 106*a* and has a structure similar to that of the upper tray 106*a*.

The transporters 104 are arranged near the image forming apparatus 12 above the upper tray 106*a* and the lower tray 106*b* in the housing 106, respectively. A panel 106*e* is provided in a removable manner on a side of the upper tray 106*a* in the housing 106 opposite the image forming apparatus 12. When the extension option 110 is attached to the sheet container 102, the panel 106*e* is removed to form an opening 106*c* on the side of the upper tray 106*a*. The housing 106 has an openable cover 106*f* that covers the upper tray 106*a* from the top. The panel 106*e* is removed and the cover 106*f* is opened to form a space through which the long sheets PL are stacked on an extended stacking surface 121 described later from the top.

As described above, the sheet container 102 has at least the housing 106, the stacking plate 108, the threaded holes 108*c*, the end guide 170, and the shutter 140.

(Sheet Container with Extension Option)

Next, description is made about the sheet container 102 with the extension option 110.

Figure 2:
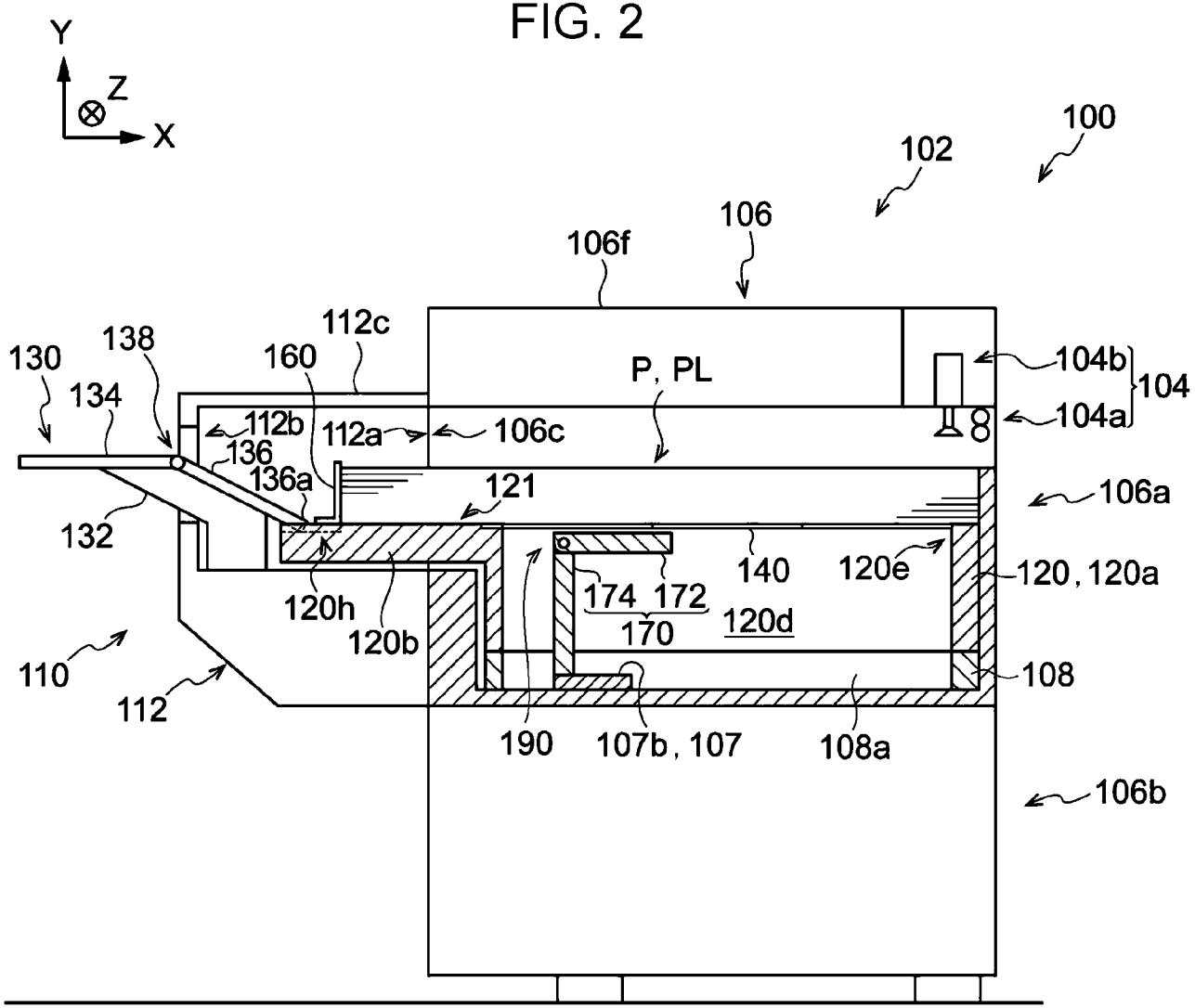
FIG. 2 is a front sectional view illustrating the sheet feeder in which long sheets are stacked on a first extension member according to the exemplary embodiment.

As illustrated in FIG. 2, the extension option 110 includes an extension cover 112, the first extension member 120, a second extension member 130, and an option guide 160.

(Extension Cover)

As illustrated in FIG. 2, the extension cover 112 is a box-shaped member attached to an outer part of the housing 106 to cover the opening 106*c* of the housing 106. The extension cover 112 houses a part of a projecting plate 120*b* of the first extension member 120, which projects outward from the housing 106 through the opening 106*c*. The extension cover 112 has an opening 112*a* continuous with the opening 106*c* of the housing 106, and an opening 112*b* on a side opposite the housing 106. The extension cover 112 has an openable cover 112*c* that covers the housing part of the extension cover 112 from the top. The cover 112*c* is opened to form a space through which the long sheets PL are stacked on the extended stacking surface 121 from the top.

(First Extension Member)

Figure 5:
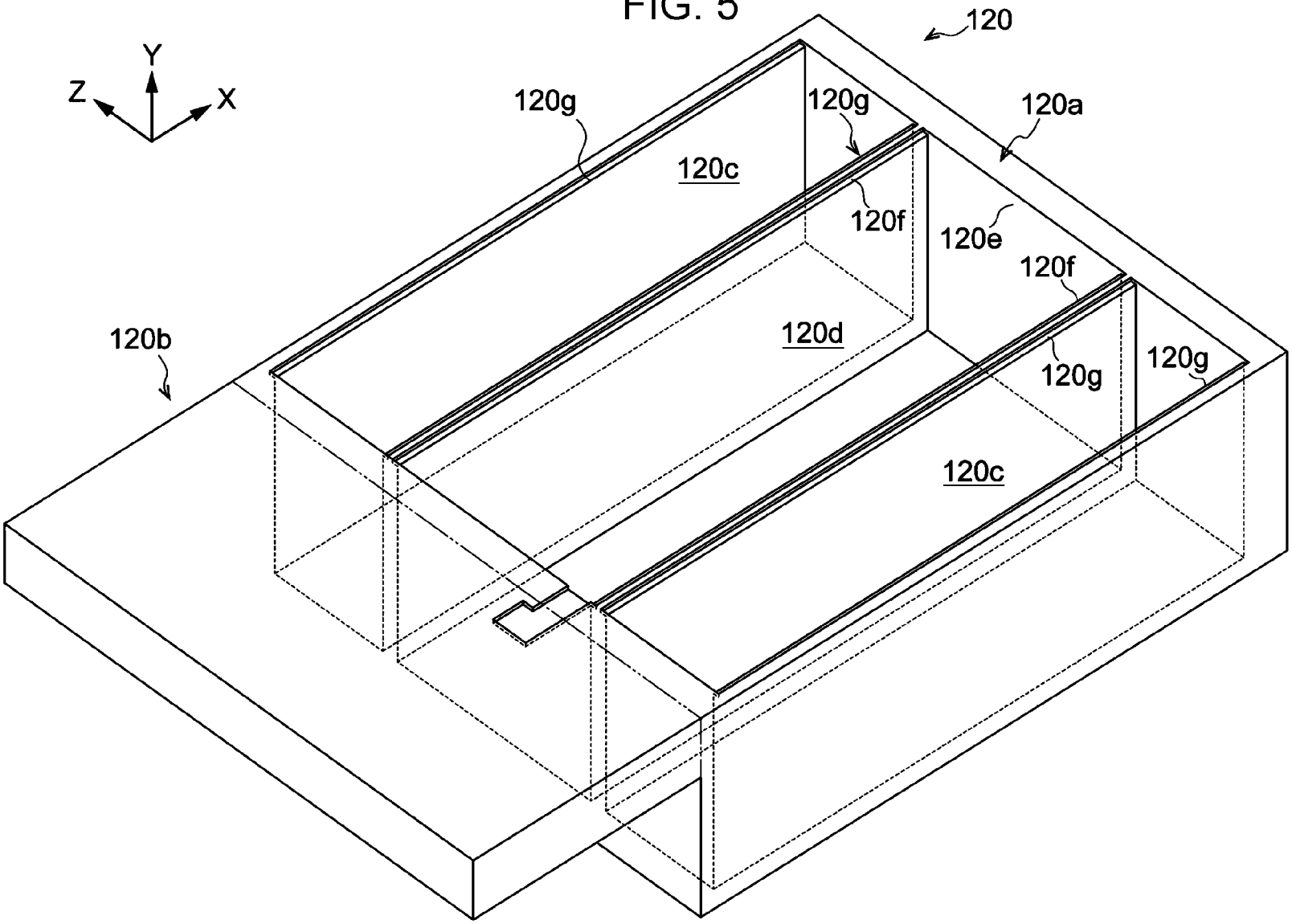
FIG. 5 is a perspective view illustrating the first extension member according to the exemplary embodiment.

As illustrated in FIG. 5, the first extension member 120 includes a frame 120*a* and the projecting plate 120*b*. The frame 120*a* is rectangular when viewed in the height direction. The projecting plate 120*b* projects from the frame 120*a* and extends away from the image forming apparatus 12. The projecting plate 120*b* is a flat plate extending along the upper surface of the frame 120*a*.

Figure 3:
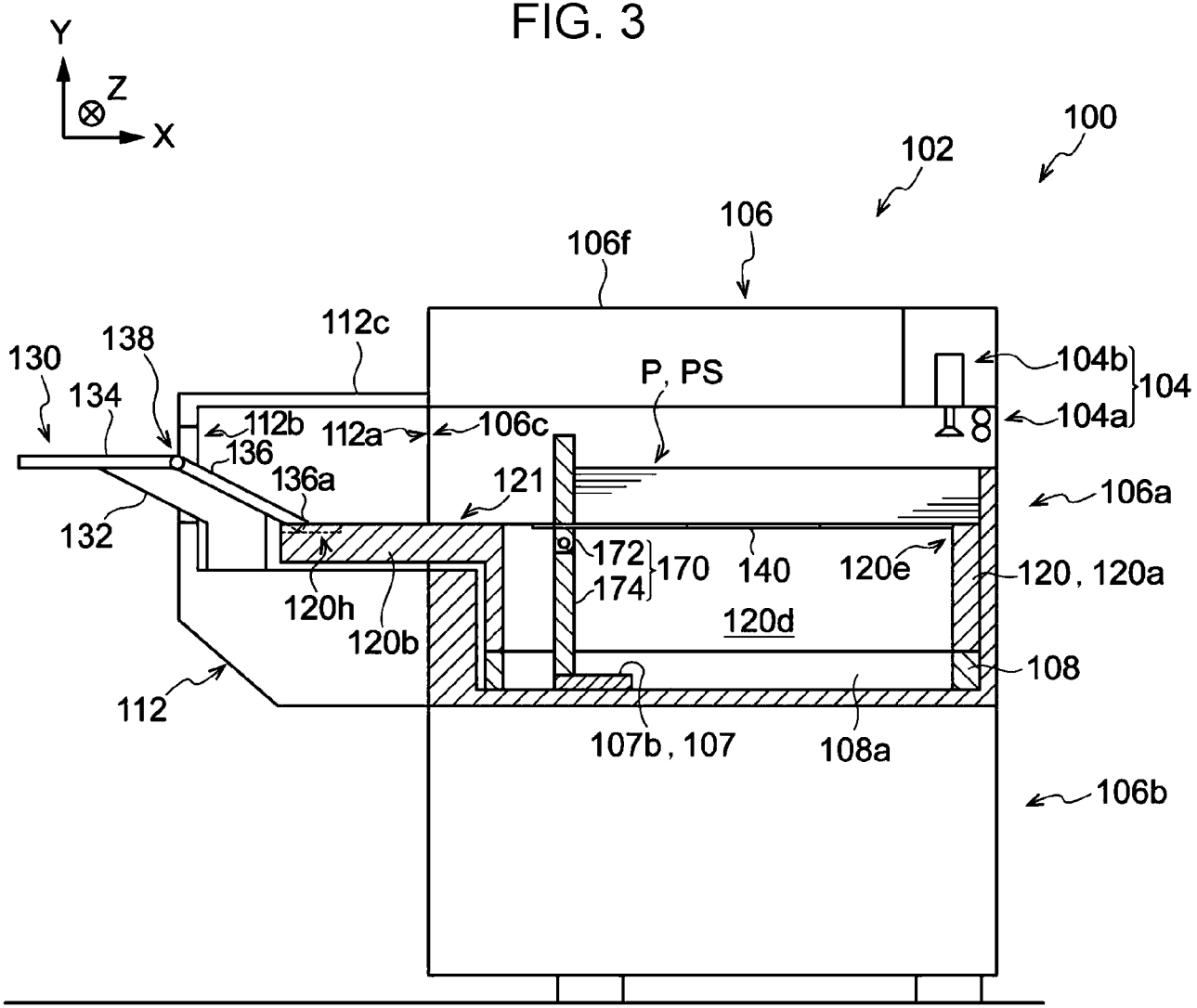
FIG. 3 is a front sectional view illustrating the sheet feeder in which non-long sheets are stacked on the first extension member according to the exemplary embodiment.

The lower end of the frame 120*a* of the first extension member 120 is positioned on the stacking plate 108 of the upper tray 106*a*. The frame 120*a* is connected to the stacking plate 108 with screws (not illustrated) driven into the threaded holes 108*c* of the stacking plate 108. The projecting plate 120*b* projects from the housing 106 through the opening 106*c*. Therefore, the upper tray 106*a* is not drawable while the first extension member 120 is connected. In FIG. 2 and FIG. 3, illustration is omitted for the screws and the threaded holes 108*c* that connect the first extension member 120 to the stacking plate 108.

The first extension member 120 has the extended stacking surface 121 defined by the upper end of the frame 120*a* and the projecting plate 120*b*. The extended stacking surface 121 is an example of an extension part longer than the stacking plate 108 in the width direction. The first extension member 120 is an example of the connection member having the extended stacking surface 121.

As illustrated in FIG. 5, the frame 120*a* has rectangular cavities 120*c* formed on both sides in the depth direction and extending in the height direction. The frame 120*a* has a rectangular cavity 120*d* formed between the two cavities 120*c* and extending in the height direction. The cavities 120*c* are continuous with the side cavities of the stacking plate 108. The cavity 120*d* is continuous with the cavity 108*a* of the stacking plate 108.

The cavity 120*d* is longer than an upper part 172 of the end guide 170 described later in the width direction. The frame 120*a* has an opening 120*e* at the top of the cavity 120*d*. The size of the opening 120*e* is substantially equal to that of the opening 108*e* of the stacking plate 108. The opening 120*e* allows the end guide 170 to move in the width direction by the slide mechanism 107. The frame 120*a* has placement parts 120*f* at the top of the cavity 120*d* on both sides in the depth direction so that the shutter 140 may be placed over the cavity 120*d*. The frame 120*a* also has placement parts 120*g* at the top of each cavity 120*c* on both sides in the depth direction so that the side shutter 150 may be placed over the cavity 120*c*.

As illustrated in FIG. 2, the projecting plate 120*b* has recesses 120*h* at the top of its end opposite the image forming apparatus 12. The recesses 120*h* receive two distal ends 136*a* of the second extension member 130 described later.

The sheets P are stacked on the extended stacking surface 121 at a position higher than the upper surface of the stacking plate 108 in the height direction. In other words, the first extension member 120 raises the stacking position of the sheets P from the upper surface of the stacking plate 108 to limit the stacking amount of the sheets P in the height direction on the upper tray 106*a* to a smaller amount than in a case where the first extension member 120 is not connected. The first extension member 120 is an example of the raising member that raises the stacking position of the sheets P and is also an example of the connection member described above. The cavity 120*d* is an example of a raising space defined by the raising member. The end guide 170 extending in the height direction projects through the opening 120*e* of the first extension member 120 beyond the extended stacking surface 121 (see FIG. 3 and FIG. 7).

When the stacking plate 108 of the upper tray 106*a* is moved in the height direction by the lift (not illustrated), the first extension member 120 moves together with the stacking plate 108.

(Second Extension Member)

As illustrated in FIG. 2, the second extension member 130 includes a support 132 and a rectangular plate 134. The support 132 is attached into the extension cover 112. The plate 134 is fixed to the support 132 and projects in the width direction through the opening 112*b* of the extension cover 112. The second extension member 130 further includes a hinge 138 and a rectangular plate 136. The hinge 138 is provided at an edge of the plate 134 that faces the image forming apparatus 12. One end of the plate 136 is supported so that the plate 136 turns about the hinge 138. The height of the upper surface of the plate 134 is set equal to the height of the uppermost non-long sheet PS on the stacking plate 108. The plate 136 has the two distal ends 136*a* at an end opposite the hinge 138. The distal ends 136*a* project along the surface of the plate 136. The two distal ends 136*a* are brought into contact with the bottom surfaces of the recesses 120*h* of the first extension member 120. The second extension member 130 is removable from the extension cover 112.

When the stacking plate 108 is located at the bottom of the upper tray 106*a* as illustrated in FIG. 2, the plate 136 having the distal ends 136*a* in contact with the bottom surfaces of the recesses 120*h* of the first extension member 120 is inclined with respect to the width direction. When the first extension member 120 connected to the stacking plate 108 is moved in the height direction by the lift (not illustrated), the plate 136 in contact with the recesses 120*h* slides along the recesses 120*h* of the moving first extension member 120 to turn about the hinge 138. When the upper surface of the first extension member 120 is moved by the lift (not illustrated) to a height equal to that of the uppermost non-long sheet PS on the stacking plate 108, the upper surface of the plate 136 is located at the same height as that of the non-long sheet PS.

(Option Guide)

As illustrated in FIG. 2, the option guide 160 has an L-shape when viewed in the depth direction and is arranged in a removable manner on the first extension member 120 or the second extension member 130. The option guide 160 is arranged with its side surface including a corner oriented toward the image forming apparatus 12. The option guide 160 is brought into contact with the edges of the sheets on the first extension member 120 or the second extension member 130 opposite the image forming apparatus 12 to suppress movement of the sheets away from the image forming apparatus 12. The option guide 160 may be arranged in a removable manner at an arbitrary position on the first extension member 120 or the second extension member 130 by, for example, a magnet plate provided at the bottom of the option guide 160.

(Folding Structure)

Figure 8:
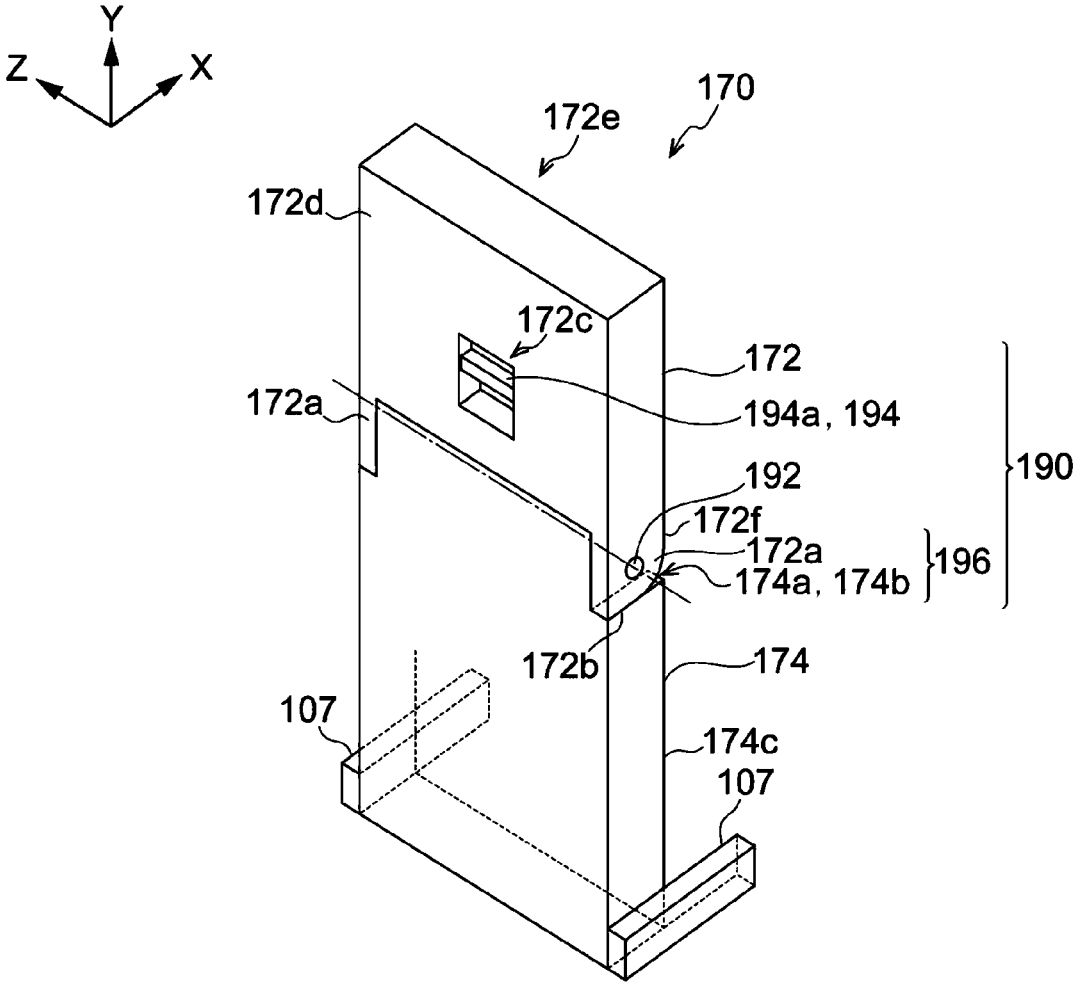
FIG. 8 is a perspective view illustrating a posture of the end guide that extends in the vertical direction according to the exemplary embodiment.

As illustrated in FIG. 8, the end guide 170 is divided into the upper part 172 and a lower part 174 to define a folding structure 190. The folding structure 190 includes a shaft 192, a lock mechanism 194, and a stopper 196.

The lower part 174 has a rectangular parallelepiped body 174*c* extending in the height direction. The height of the body 174*c* is set smaller than the height of the bottom surface of the placement part 120*f* of the first extension member 120 connected to the stacking plate 108. The body 174*c* has steps 174*a* at its upper end on both sides in the depth direction. The steps 174*a* have stepped surfaces 174*b* relative to the upper surface of the body 174*c*. In the exemplary embodiment, the height of the body 174*c* is set larger than the height of the middle part of the end guide 170 in the height direction.

As illustrated in FIG. 8, the upper part 172 has a rectangular parallelepiped body 172*e* and two projecting plates 172*a*. The body 172*e* is arranged above the lower part 174 of the end guide 170 and extends in the height direction. The projecting plates 172*a* projects from both sides of the lower surface of the body 172*e* in the depth direction. The body 172*e* has a rectangular recess 172*c* at the center of a side surface 172*d* opposite the image forming apparatus 12. Each projecting plate 172*a* is a flat plate extending along the side surface of the body 172*e* and is arranged above the step 174*a* of the lower part 174. As illustrated in FIG. 8, the projecting plate 172*a* has a lower end surface 172*b* and a side surface 172*f* that faces the image forming apparatus 12.

The shaft 192 is arranged through the projecting plates 172*a* of the upper part 172 and the body 174*c* of the lower part 174 in the depth direction and supports the upper part 172 in a turnable manner.

The lock mechanism 194 has a known structure inside the end guide 170 to restrain a turn of the upper part 172 about the shaft 192. The lock mechanism 194 includes a lever 194*a*. The lever 194*a* is an example of a manipulator for the folding structure 190 and may be pulled up toward the distal end of the end guide 170 in the recess 172*c*. The restraint of the turn of the upper part 172 about the shaft 192 by the lock mechanism 194 is terminated by raising the lever 194*a*.

The stopper 196 is an example of a regulator that regulates a turnable range of the upper part 172 about the shaft 192. The stopper 196 includes the projecting plates 172*a* of the upper part 172 and the steps 174*a* of the lower part 174.

When the upper part 172 is in a posture in which the upper part 172 extends in the height direction as illustrated in FIG. 8 (hereinafter referred to as "upright posture"), the end surfaces 172*b* of the projecting plates 172*a* interfere with the stepped surfaces 174*b* of the steps 174*a*. That is, the stopper 196 prevents the upper part 172 in the upright posture from tilting away from the image forming apparatus 12 about the shaft 192.

Figure 9:
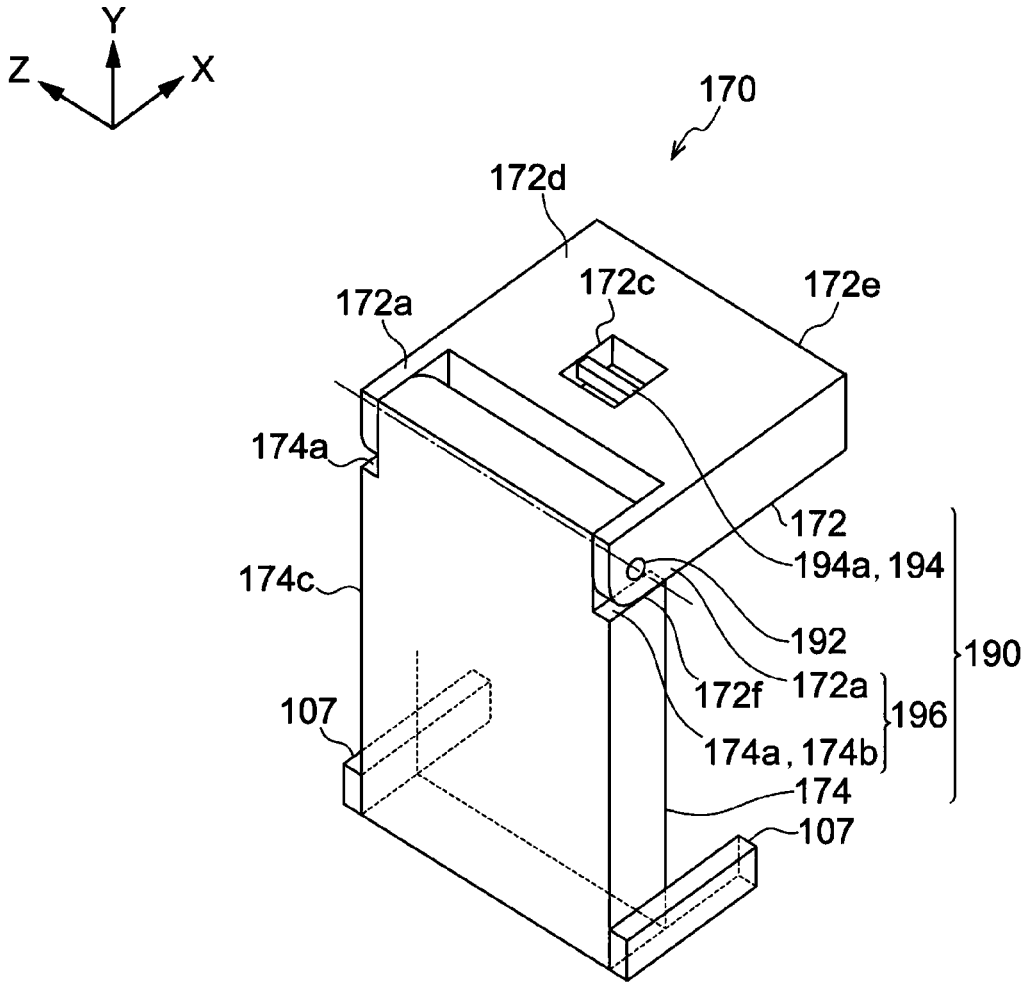
FIG. 9 is a perspective view illustrating a retreated state of the end guide according to the exemplary embodiment.

When the upper part 172 is in a posture in which the upper part 172 turns about the shaft 192 to tilt toward the image forming apparatus 12 and therefore extends in the width direction as illustrated in FIG. 9 (hereinafter referred to as "horizontal posture"), the stepped surfaces 174*b* of the steps 174*a* interfere with the side surfaces 172*f* of the projecting plates 172*a*. Thus, the upper part 172 in the horizontal posture is prevented from tilting toward the lower part 174 about the shaft 192. In the exemplary embodiment, the stopper 196 regulates the upper part 172 so that the upper part 172 in the upright posture tilts at an angle of 80° or larger and 100° or smaller.

The structure of the stopper 196 is not limited to the structure described above. For example, when the upper part 172 is in the upright posture, a thin plate projecting from the side surface 172*d* of the upper part 172 toward the projecting plates 172*a* may interfere with a side surface of the lower part 174 opposite the image forming apparatus 12.

As described above, the end guide 170 may switch the two postures of the upper part 172, that is, the upright posture (see FIG. 8) and the horizontal posture (see FIG. 9), by using the folding structure 190. The operation of switching the upper part 172 of the end guide 170 from the upright posture to the horizontal posture is referred to as an operation of "folding the end guide 170". When the end guide 170 switches the two postures, the upper part 172 passes through the opening 120*e*.

When the upper part 172 is in the folded posture as illustrated in FIG. 9, the height of the end guide 170 attached to the bottom of the upper tray 106*a* by the slide mechanism 107 is equal to the height of the lower part 174. As illustrated in FIG. 2, the end guide 170 in this state does not project beyond the extended stacking surface 121 but retracts into the cavity 120*d* of the first extension member 120. Therefore, the end guide 170 does not interfere with the long sheets PL stacked on the extended stacking surface 121. In other words, the end guide 170 attached into the housing 106 by the slide mechanism 107 is folded by the folding structure 190 to retreat from the extended stacking surface 121. The "retreat from the extended stacking surface 121" means that the end guide 170 does not interfere with the uppermost long sheet PL on the extended stacking surface 121. The folding structure 190 may be regarded as an example of a retreater that retreats the end guide 170 in the attached state from the extended stacking surface 121. When the end guide 170 is retreated from the extended stacking surface 121 by the folding structure 190, the long sheets PL may be stacked on the extended stacking surface 121 (see FIG. 2). The long sheets PL stacked on the extended stacking surface 121 are brought into contact with the option guide 160 and movement of the long sheets PL away from the image forming apparatus 12 is suppressed.

Figure 7:
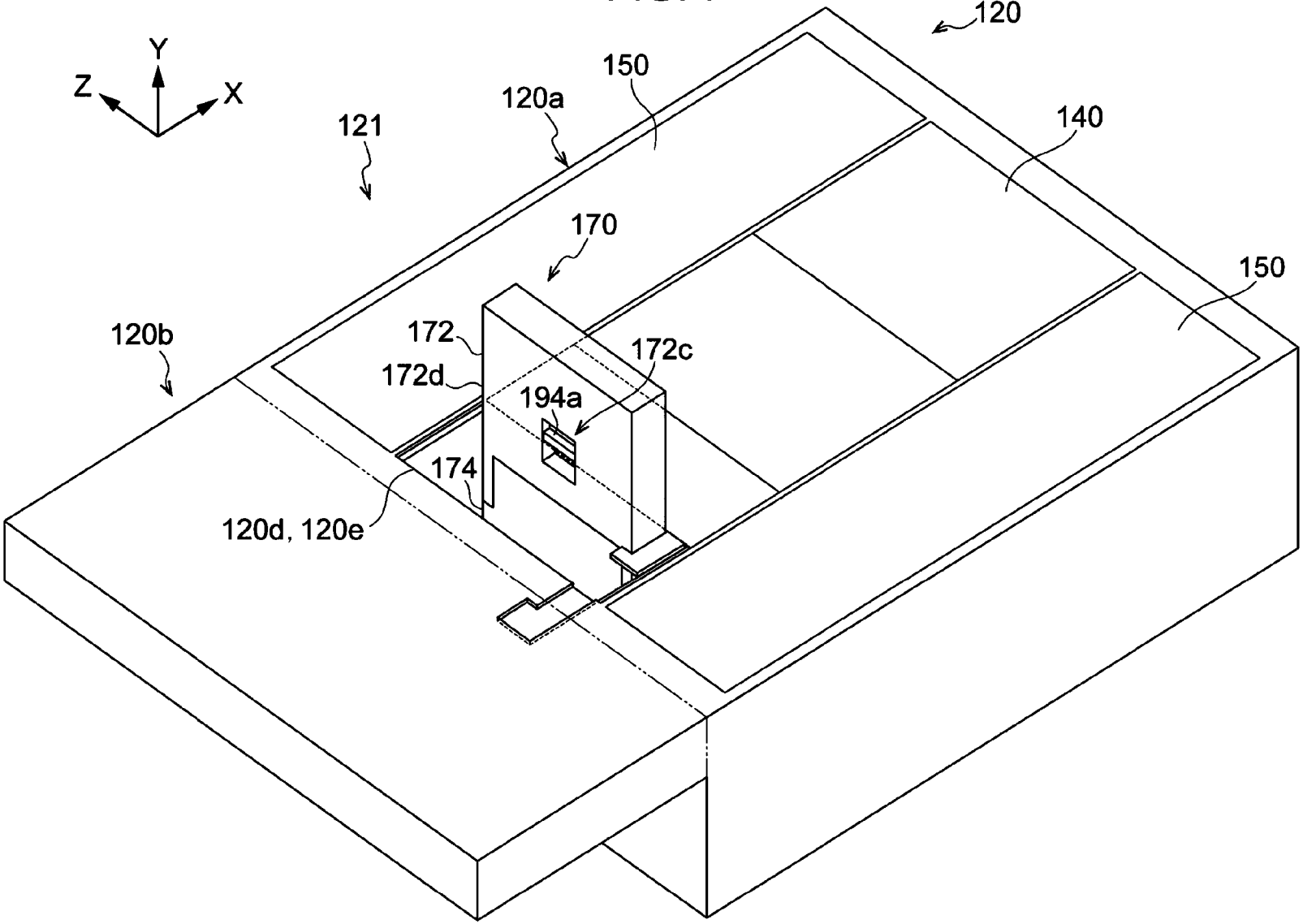
FIG. 7 is a perspective view illustrating the first extension member and an end guide extending in a vertical direction according to the exemplary embodiment.

When the first extension member 120 is connected to the stacking plate 108 as illustrated in FIG. 7, the end guide 170 extending in the height direction projects through the opening 120*e* of the first extension member 120 beyond the extended stacking surface 121. At this time, the non-long sheets PS may be stacked on the extended stacking surface 121 (see FIG. 3). The non-long sheets PS stacked on the extended stacking surface 121 are brought into contact with the end guide 170 extending in the height direction and movement of the non-long sheets PS away from the image forming apparatus 12 is suppressed.

(Others)

Figure 6:
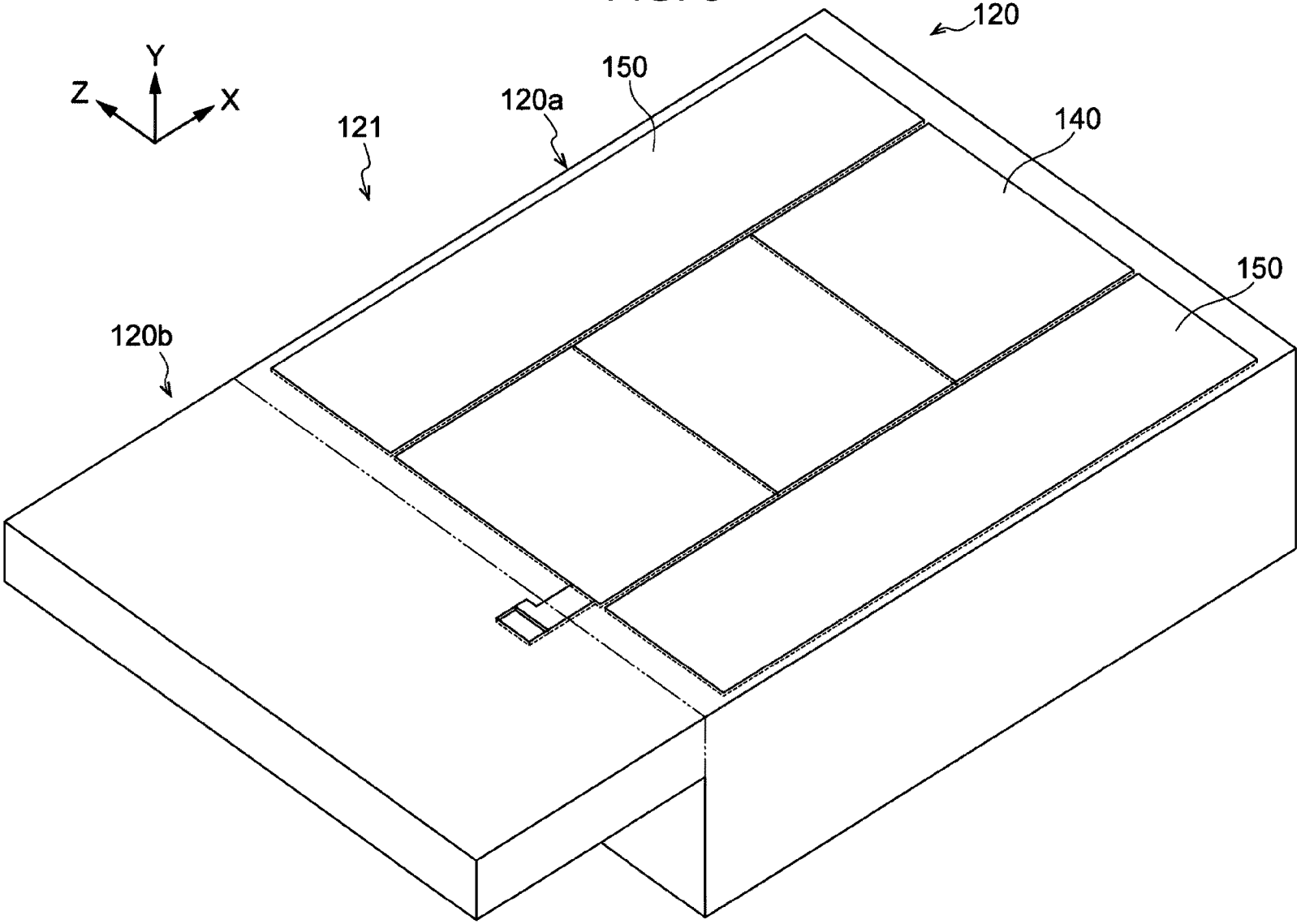
FIG. 6 is a perspective view illustrating the first extension member and a first shutter according to the exemplary embodiment.

When the first extension member 120 is connected to the stacking plate 108, the shutter 140 and the side shutters 150 are arranged in a removable manner on the placement parts 120*f* and 120*g* of the first extension member 120 as illustrated in FIG. 6, respectively. When the shutter 140 and the side shutters 150 are arranged on the first extension member 120, the sheets P on the extended stacking surface 121 are supported by the first extension member 120, the shutter 140, and the side shutters 150 (see FIG. 2). Thus, the sheets P on the extended stacking surface 121 are placed along the width direction. The shutter 140 extends or contracts when the end guide 170 extending in the height direction and projecting beyond the extended stacking surface 121 moves in the width direction, thereby closing a part of the opening 120*e* near the image forming apparatus 12 with respect to the end guide 170. The shutter 140 is an example of an opening/closing member that opens or closes the opening 120*e*.

[Structure of Sheet Container 200]

Next, the structure of the sheet container 200 is described. The structure of the sheet container 200 is similar to that of the sheet container 102 except that the top of the housing 106 and the top of the extension cover 112 in the sheet container 102 are open. The sheet container 200 adjoins the image forming apparatus 12 opposite the sheet feeder 100 while being oriented opposite the sheet container 102 in the width direction.

In the following description, comparative examples and comparative apparatuses may be provided in comparison with the exemplary embodiment of the present disclosure. When the components of the image forming system 10 according to the exemplary embodiment of the present disclosure are described, the reference symbols and names of the components are used as they are.

The first extension member 120 serves as the connection member having the extended stacking surface 121 and as the raising member that raises the stacking position of the sheets P. In other words, the first extension member 120 has the connection member and the raising member integrated together.

The sheet container 102 has the structure in which a part of the projecting plate 120*b* of the first extension member 120 projects outward from the housing 106 through the opening 106*c* of the housing 106 (first structure). That is, the size of the housing 106 of the sheet container 102 depends on the size of the frame 120*a* of the first extension member 120. The size of a housing of a sheet container having the projecting plate 120*b* inside the housing (first comparative apparatus) depends on the size of the first extension member 120 including the projecting plate 120*b*. The first comparative apparatus is encompassed in the technical thought of the exemplary embodiment of the present disclosure as its modified example.

The sheet container 102 has the structure in which the folding structure 190 retreats the end guide 170 to a space below the extended stacking surface 121 (second structure). The sheet container 102 having the second structure is compared with a sheet container in which the end guide retreats to a space above the extended stacking surface 121 (second comparative apparatus). The structure of the second comparative apparatus is similar to that of the sheet container 102 except that the end guide of the upper tray 106*a* is attached to a ceiling of the upper tray 106*a* while being inverted compared with the end guide 170 of the exemplary embodiment. In the second comparative apparatus, the maximum stacking amount of the sheets P in the height direction on the extended stacking surface 121 is limited by a space from the extended stacking surface 121 to the end guide because the end guide retreats to the space above the extended stacking surface 121. In the sheet container 102 having the second structure, the maximum stacking amount of the sheets P in the height direction on the extended stacking surface 121 is not limited by the space from the extended stacking surface 121 to the end guide. The second comparative apparatus is encompassed in the technical thought of the exemplary embodiment of the present disclosure as its modified example.

The sheet container 102 has the structure in which the end guide 170 retreats from the extended stacking surface 121 to the cavity 120*d* of the first extension member 120 (third structure). The sheet container 102 having the third structure is compared with a sheet container in which the end guide 170 retreats to a space provided on a side of the first extension member 120 (third comparative apparatus). The structure of the third comparative apparatus is similar to that of the sheet container 102 except that the end guide 170 retreats to that space. In the third comparative apparatus, the size of the housing of the third comparative apparatus depends on the sizes of the first extension member 120 and the space because the space is provided on the side of the first extension member 120. In the sheet container 102, the space corresponds to the cavity 120*d* of the first extension member 120 and the size of the housing 106 is smaller than that of the housing of the third comparative apparatus by an amount corresponding to the space. The third comparative apparatus is encompassed in the technical thought of the exemplary embodiment of the present disclosure as its modified example.

Figure 10A:
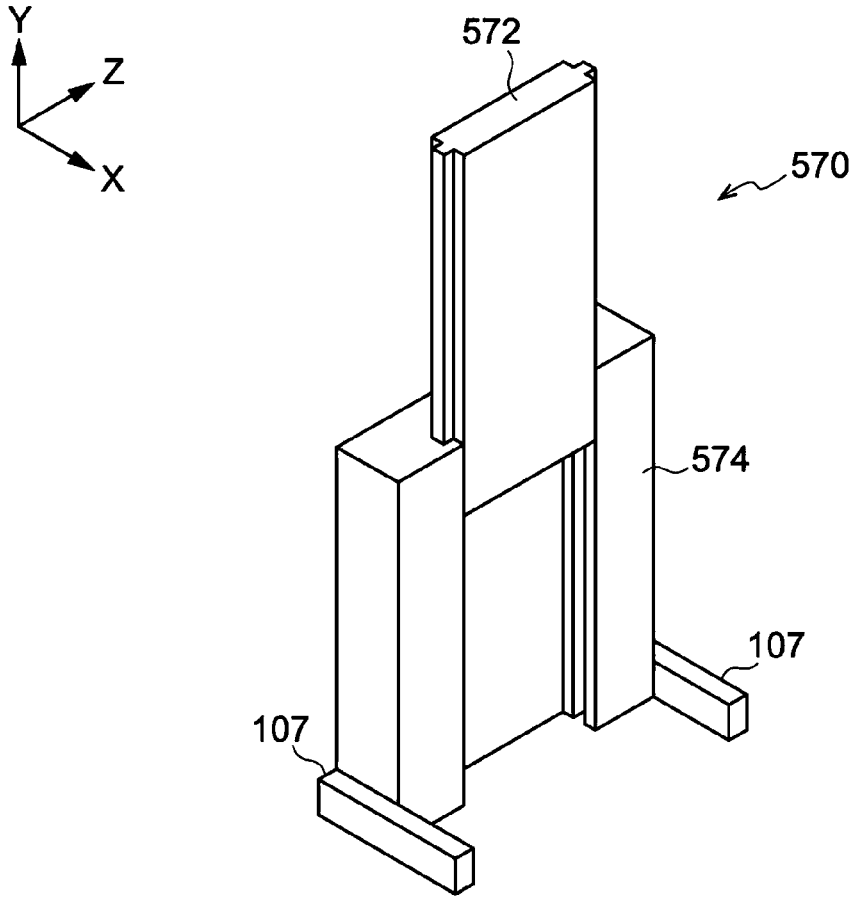
FIG. 10A is a perspective view illustrating a posture of an end guide that extends in a vertical direction according to a comparative example compared with the exemplary embodiment.
Figure 10B:
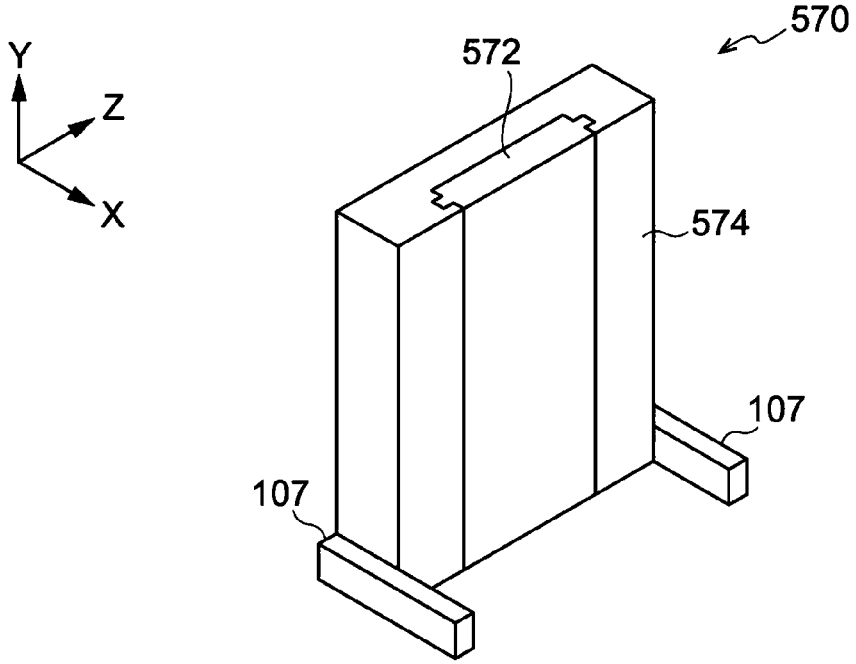
FIG. 10B is a perspective view illustrating a retreated state of the end guide according to the comparative example.

The sheet container 102 has the structure in which the upper part 172 extending in the height direction (see FIG. 8) is tilted into the horizontal posture (see FIG. 9) by the folding structure 190 to retreat from the extended stacking surface 121 (fourth structure). The sheet container 102 having the fourth structure is compared with a sheet container including an end guide 570 illustrated in FIGS. 10A and 10B (fourth comparative apparatus). The structure of the fourth comparative apparatus is similar to that of the sheet container 102 except that the end guide 570 has a nesting structure as illustrated in FIGS. 10A and 10B and retreats from the extended stacking surface 121 by retracting an upper part 572 into a lower part 574. In the fourth comparative apparatus, the upper part 572 is thinner than the lower part 574 in the width direction and the strength of the upper part 572 is lower than that of the lower part 574 because of the nesting structure of the end guide 570. In the sheet container 102 having the fourth structure, the upper part 172 is not thinner than the lower part 174 in the width direction and the decrease in the strength is suppressed. The fourth comparative apparatus is encompassed in the technical thought of the exemplary embodiment of the present disclosure as its modified example.

The height of the lower part 174 is set larger than the height of the middle part of the end guide 170 in the height direction. That is, the sheet container 102 has the structure in which the upper part 172 positioned above the middle part of the end guide 170 in the height direction tilts in the width direction (fifth structure). The sheet container 102 having the fifth structure is compared with a sheet container including an end guide 170 that retreats from the extended stacking surface 121 by tilting at the root of the lower part 174 (fifth comparative apparatus). The structure of the fifth comparative apparatus is similar to that of the sheet container 102 except that the end guide 170 retreats from the extended stacking surface 121 by tilting at the root of the lower part 174. In the fifth comparative apparatus, the end guide 170 retreats from the extended stacking surface 121 by tilting at the root of the lower part 174, that is, tilting in a range from the upper part 172 to the lower part 174. In the sheet container 102 having the fifth structure, the end guide 170 retreats from the extended stacking surface 121 by tilting the upper part 172 alone. Thus, the movement range of the retreating end guide 170 is narrower in the sheet container 102 than in the fifth comparative apparatus. The fifth comparative apparatus is encompassed in the technical thought of the exemplary embodiment of the present disclosure as its modified example.

The sheet container 102 has the structure in which the upper part 172 of the end guide 170 tilts in the direction in which the upper part 172 is brought into contact with the sheets P (sixth structure). The sheet container 102 having the sixth structure is compared with a sheet container including an end guide 170 that retreats from the extended stacking surface 121 by tilting the upper part 172 in a direction opposite the direction in which the upper part 172 is brought into contact with the sheets P (sixth comparative apparatus). The structure of the sixth comparative apparatus is similar to that of the sheet container 102 except that the end guide 170 retreats from the extended stacking surface 121 by tilting the upper part 172 in the direction opposite the direction in which the upper part 172 is brought into contact with the sheets P, that is, tilting the upper part 172 away from the image forming apparatus 12. Since the upper part 172 of the sixth comparative apparatus tilts away from the image forming apparatus 12, the upper part 172 may interfere with the housing 106 when the end guide 170 farthest from the image forming apparatus 12 in the cavity 120*d* retreats. In the sheet container 102 having the sixth structure, the end guide 170 farthest from the image forming apparatus 12 in the cavity 120*d* retreats by tilting the upper part 172 in the direction in which the upper part 172 is brought into contact with the sheets P, that is, in a direction in which the upper part 172 does not interfere with the housing 106. The sixth comparative apparatus is encompassed in the technical thought of the exemplary embodiment of the present disclosure as its modified example.

The sheet container 102 has the structure in which the end guide 170 retreats by tilting the upper part 172 in the upright posture at the angle of 100° or smaller (seventh structure). The sheet container 102 having the seventh structure is compared with a sheet container in which the upper part 172 of the end guide 170 in the upright posture tilts at an angle larger than 100° (seventh comparative apparatus). The structure of the seventh comparative apparatus is similar to that of the sheet container 102 except that the upper part 172 of the end guide 170 in the upright posture tilts at the angle larger than 100°. In the sheet container 102 having the seventh structure, the tilting motion of the upper part 172 when the end guide 170 retreats is smaller than that in the seventh comparative apparatus. The seventh comparative apparatus is encompassed in the technical thought of the exemplary embodiment of the present disclosure as its modified example.

The sheet container 102 has the structure in which the end guide 170 retreats by tilting the upper part 172 in the upright posture at the angle of 80° or larger (eighth structure). The sheet container 102 having the eighth structure is compared with a sheet container in which the upper part 172 of the end guide 170 in the upright posture tilts at an angle smaller than 80° (eighth comparative apparatus). The structure of the eighth comparative apparatus is similar to that of the sheet container 102 except that the upper part 172 of the end guide 170 in the upright posture tilts at the angle smaller than 80°. The height of the first extension member having the extended stacking surface depends on the height of the retreated end guide 170. The height of the end guide 170 in which the upper part 172 in the upright posture tilts at the angle of 80° or larger is smaller than the height of the end guide 170 in which the upper part 172 tilts from the lower part 174 at the angle smaller than 80°. In the sheet container 102 having the eighth structure, the height of the first extension member 120 having the extended stacking surface 121 is smaller than the height of the first extension member of the eighth comparative apparatus. The eighth comparative apparatus is encompassed in the technical thought of the exemplary embodiment of the present disclosure as its modified example.

The sheet container 102 has the structure in which the extended stacking surface 121 has the opening 120*e* through which the upper part 172 may pass. Thus, even though the extension option 110 is attached to the sheet container 102, the upper part 172 of the retreated end guide 170 may pass through the opening 120*e* into the upright posture to project beyond the extended stacking surface 121. The end guide 170 projecting beyond the extended stacking surface 121 and extending in the height direction is brought into contact with the non-long sheets PS stacked on the extended stacking surface 121.

In the sheet container 102, the opening 120*e* is shaped such that the end guide 170 is allowed to move in the width direction by the slide mechanism 107.

In the sheet container 102, the cavity 120*d* is formed in the frame 120*a* of the first extension member 120. In other words, the opening 120*e* at the top of the cavity 120*d* is formed within the range of the stacking plate 108.

The sheet container 102 includes the shutter 140 that opens or closes the opening 120*e* in the extended stacking surface 121 or the opening 108*e* in the stacking plate 108. When the shutter 140 closes the opening 120*e* or the opening 108*e*, the sheets P on the extended stacking surface 121 or the stacking plate 108 are placed along the width direction.

The shutter 140 of the sheet container 102 closes a part of the opening 120*e* or the opening 108*e* near the image forming apparatus 12 with respect to the end guide 170 in response to the movement of the end guide 170 in the width direction. In other words, the first shutter 140 closes the opening 120*e* or the opening 108*e* on a side where the end guide 170 is brought into contact with the sheets P.

The end guide 170 may switch the two postures, that is, the upright posture (see FIG. 8) and the folded posture (see FIG. 9), by using the folding structure 190. When the long sheets PL are stacked on the extended stacking surface 121 in the sheet container 102, the end guide 170 is folded to retreat from the extended stacking surface 121, thereby bringing the option guide 160 into contact with the long sheets PL. When the non-long sheets PS are stacked on the extended stacking surface 121 in the sheet container 102, the end guide 170 is extended in the height direction to project beyond the extended stacking surface 121, thereby bringing the end guide 170 into contact with the non-long sheets PS.

In the sheet container 200, the first extension member 120 is connected to define the extended stacking surface 121 where the long sheets may be stacked.

Modified Example 1

Next, Modified Example 1 of the exemplary embodiment is described. When the components of the image forming system 10 according to the exemplary embodiment are described in Modified Example 1, the reference symbols and names of the components are used as they are.

The sheet container 102 of Modified Example 1 may contain the long sheets PL by attaching an extension option 310 to the upper tray 106*a*. The extension option 310 of Modified Example 1 includes the extension cover 112, a raising member 320*a*, a first extension member 320*b*, the second extension member 130, and the option guide 160.

Figure 11:
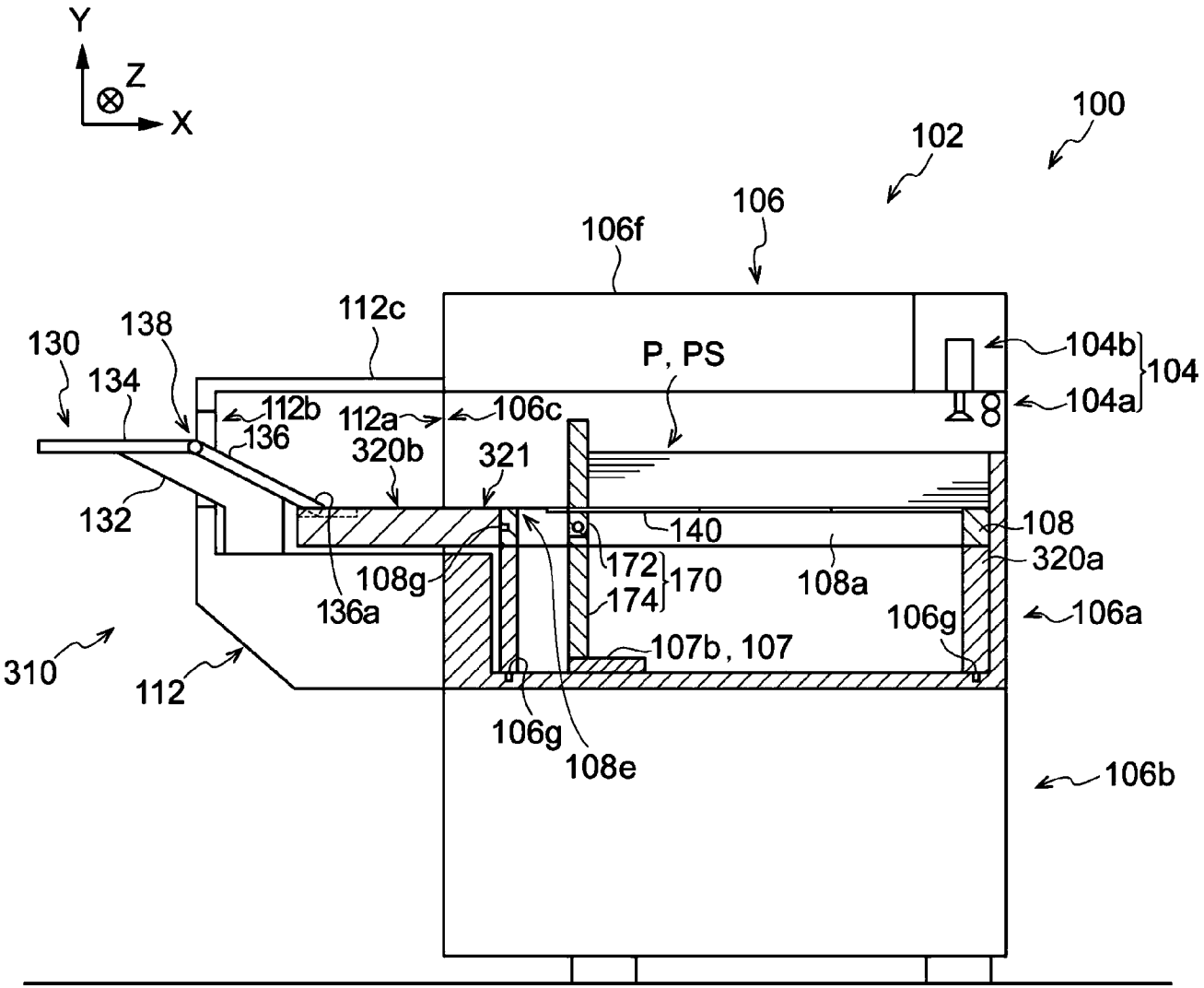
FIG. 11 is a front sectional view illustrating Modified Example 1 of the sheet feeder according to the exemplary embodiment.

In Modified Example 1, the upper tray 106*a* has threaded holes 106*g* at the bottom (see FIG. 11). The threaded hole 106*g* is an example of a receptacle to which the raising member 320*a* described later is attached.

In Modified Example 1, the stacking plate 108 has threaded holes 108*g* at its end opposite the image forming apparatus 12 (see FIG. 11). The threaded hole 108*g* is an example of a connector to which the first extension member 320*b* described later is connected.

The raising member 320*a* has the same structure as that of the frame 120*a* of the first extension member 120 according to the exemplary embodiment. The raising member 320*a* is attached to the upper tray 106*a* with screws (not illustrated) driven into the threaded holes 106*g* of the upper tray 106*a*. The stacking plate 108 is mounted on the raising member 320*a*. In other words, the raising member 320*a* raises the stacking plate 108. That is, the raising member 320*a* raises the stacking position of the sheets P. Thus, the raising member 320*a* limits the stacking amount of the sheets P in the height direction on the upper tray 106*a* to a smaller amount than in a case where the raising member 320*a* is not connected.

The first extension member 320*b* has a shape similar to that of the projecting plate 120*b* of the first extension member 120 according to the exemplary embodiment. The first extension member 320*b* is an example of a connection member having an extended stacking surface 321 and is connected to the stacking plate 108 with screws (not illustrated) driven into the threaded holes 108*g* of the stacking plate 108. When the first extension member 320*b* is connected to the stacking plate 108, the upper surface of the first extension member 320*b* extends along the upper surface of the stacking plate 108. Thus, the upper surface of the first extension member 320*b* and the upper surface of the stacking plate 108 raised by the raising member 320*a* define the extended stacking surface 321 that is an example of the extension part longer than the stacking plate 108 in the width direction.

In Modified Example 1, the shutter 140 is arranged on the placement parts 108*d* over the opening 108*e* in the stacking plate 108 raised by the raising member 320*a*. In Modified Example 1, each side shutter 150 is arranged on the placement parts over the side cavity in the stacking plate 108 raised by the raising member 320*a*.

When the raising member 320*a* is attached to the upper tray 106*a* as illustrated in FIG. 11, the end guide 170 extending in the height direction projects beyond the extended stacking surface 321 through the opening 108*e* of the stacking plate 108 raised by the raising member 320*a*. When the end guide 170 switches the upper part 172 between the upright posture (see FIG. 8) and the folded posture (see FIG. 9) by using the folding structure 190, the upper part 172 passes through the opening 108*e* longer than the upper part 172. The end guide 170 is folded by the folding structure 190 to retreat from the extended stacking surface 321. Thus, the long sheets PL may be stacked on the extended stacking surface 321.

In other respects, the structure of the image forming system of Modified Example 1 is similar to that in the exemplary embodiment.

Modified Example 2

Next, Modified Example 2 of the exemplary embodiment is described. When the components of the image forming system 10 according to the exemplary embodiment and the components in Modified Example 1 are described in Modified Example 2, the reference symbols and names of the components are used as they are.

The sheet container 102 of Modified Example 2 may contain the long sheets PL by attaching an extension option 311 to the upper tray 106*a*. The extension option 311 of Modified Example 2 includes the raising member 320*a*, a first extension member 330, and the option guide 160.

In Modified Example 2, the stacking plate 108 is raised by the raising member 320*a* similarly to Modified Example 1. The stacking plate 108 has a recess 108*j* at the end of its upper surface opposite the image forming apparatus 12 (see FIG. 12). The recess 108*j* receives the distal end of a plate 336 of the first extension member 330 described later.

Figure 12:
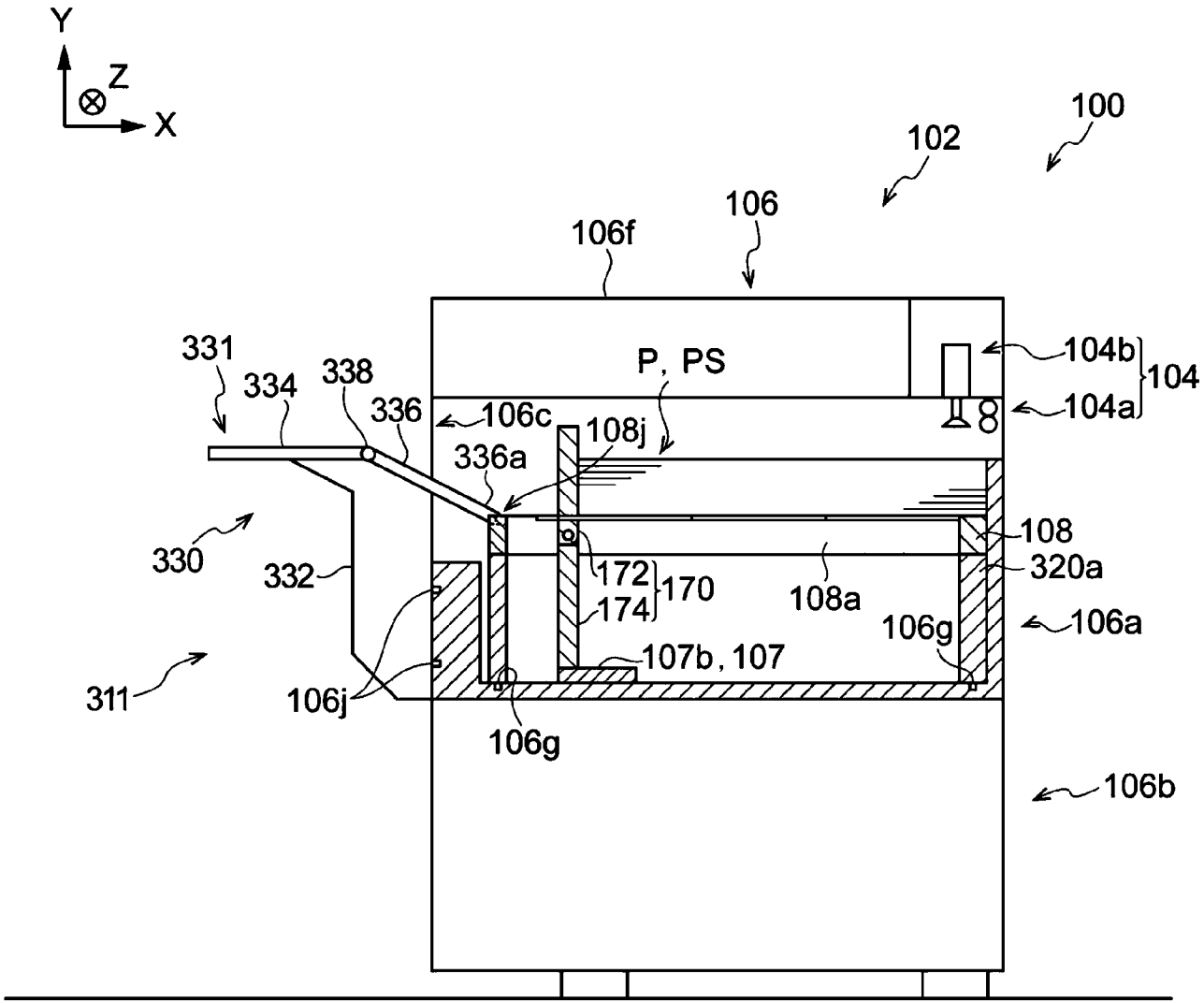
FIG. 12 is a front sectional view illustrating Modified Example 2 of the sheet feeder according to the exemplary embodiment.

In Modified Example 2, the housing 106 has threaded holes 106*j* in its side surface opposite the image forming apparatus 12 (see FIG. 12). The threaded hole 106*j* is an example of a connector to which the first extension member 330 described later is connected.

The first extension member 330 includes a support 332, a plate 334, the plate 336, and a hinge 338 similarly to the second extension member 130 according to the exemplary embodiment. The support 332 of the first extension member 330 is connected to the housing 106 with screws (not illustrated) driven into the threaded holes 106*j* of the housing 106. A distal end 336*a* of the plate 336 of the first extension member 330 that faces the image forming apparatus 12 is brought into contact with the bottom surface of the recess 108*j* of the stacking plate 108 (see FIG. 12). Thus, the upper surfaces of the plates 334 and 336 of the first extension member 330 and the upper surface of the stacking plate 108 raised by the raising member 320*a* define an extended stacking surface 331 that is an example of the extension part longer than the stacking plate 108 in the width direction.

When the raising member 320*a* is attached to the upper tray 106*a* as illustrated in FIG. 12, the end guide 170 extending in the height direction projects beyond the extended stacking surface 331 through the opening 108*e* of the stacking plate 108 raised by the raising member 320*a*. When the end guide 170 switches the upper part 172 between the upright posture (see FIG. 8) and the folded posture (see FIG. 9) by using the folding structure 190, the upper part 172 passes through the opening 108*e* longer than the upper part 172. The end guide 170 is folded by the folding structure 190 to retreat from the extended stacking surface 331. Thus, the long sheets PL may be stacked on the extended stacking surface 331.

In other respects, the structure of the image forming system of Modified Example 2 is similar to that in Modified Example 1.

In the exemplary embodiment, the threaded hole is the example of the connector to which the connection member is connected. However, the connector is not limited to the threaded hole. For example, the connector may be a recess formed in the upper surface of the stacking plate 108 and a projection formed on the bottom surface of the frame 120*a* of the first extension member 120 may be fitted into the recess. The connection member may be connected to the connector by a clamp mechanism. The same applies to the receptacle to which the raising member is attached.

In Modified Example 1 and Modified Example 2, the threaded hole 106*g* of the housing 106 serves as the receptacle to which the raising member 320*a* is attached. However, the receptacle may be provided at the bottom of the stacking plate 108.

In Modified Example 1, the threaded hole 108*g* of the stacking plate 108 serves as the connector to which the first extension member 320*b* is connected. However, the connector is not limited to the one provided to the stacking plate 108. For example, the connector may be a threaded hole formed in the side surface of a raising member opposite the image forming apparatus 12. In this case, the raising member is attached to the upper surface of the stacking plate 108.

In the exemplary embodiment, the folding structure 190 of the end guide 170 serves as the retreater. However, the retreater is not limited to the one provided to the end guide 170. For example, the retreater may be a retractor that is provided at the bottom of the housing 106 and retracts the end guide 170 to a space below the upper tray 106*a* by lowering the end guide 170 in the height direction.

In the exemplary embodiment, the lever 194*a* arranged in the recess 172*c* formed in the side surface 172*d* of the upper part 172 of the end guide 170 serves as the manipulator of the lock mechanism 194. However, the manipulator of the lock mechanism 194 is not limited to the lever or to the one arranged on the side surface 172*d* of the end guide 170. For example, the manipulator of the lock mechanism 194 may be a button. Further, the manipulator of the lock mechanism 194 may be arranged at the distal end of the upper part 172 of the end guide 170.

In the exemplary embodiment, the wire lift may be used as the example of the lift that moves the stacking plate 108 in the height direction. However, the lift may be provided on the stacking plate 108. Specifically, the lift may be legs that are provided on the bottom surface of the stacking plate 108 and extend or contract in the height direction.

In the exemplary embodiment, the lower tray 106*b* is arranged below the upper tray 106*a* in the housing 106. However, the housing 106 need not have the lower tray 106*b*.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet container, comprising:

a housing;

a stacking part provided in the housing so that recording sheets are stacked on the stacking part;

a contact part to be brought into contact with edges of the recording sheets in a length direction on the stacking part in an attached state in which the contact part is attached into the housing;

a connection member connected to the stacking part or the housing and having an extension part longer than the stacking part in the length direction; and a retreater that retreats the contact part in the attached state from the extension part with the connection member connected to the stacking part or the housing.

2. The sheet container according to claim 1, wherein a part of the extension part projects outward from the housing.

3. The sheet container according to claim 1, wherein the contact part is attached to a bottom side in the housing with respect to the stacking part, and wherein the retreater retreats the contact part in the attached state to a space below a stacking surface of the extension part.

4. The sheet container according to claim 3, wherein the contact part is brought into contact with the edges in a posture in which the contact part extends in a vertical direction, and wherein the retreater retreats the contact part from the extension part by tilting at least a part of the contact part in a direction intersecting the vertical direction.

5. The sheet container according to claim 4, wherein the retreater tilts, in the length direction of the recording sheets, an upper part of the contact part in the posture in which the contact part extends in the vertical direction, the upper part being positioned above a middle part of the contact part in the vertical direction.

6. The sheet container according to claim 5, wherein the retreater tilts the upper part of the contact part in a direction in which the upper part is brought into contact with the recording sheets.

7. The sheet container according to claim 5, wherein the retreater tilts, at an angle of 80° or larger and 100° or smaller, the upper part of the contact part in the posture in which the contact part extends in the vertical direction.

8. The sheet container according to claim 5, wherein the extension part has an opening through which the upper part passes.

9. The sheet container according to claim 8, wherein the contact part in the attached state is movable in the length direction relative to the housing, and wherein the opening is shaped such that the contact part is allowed to move in the length direction.

10. The sheet container according to claim 9, wherein the opening is formed within a range of the stacking part alone.

11. The sheet container according to claim 9, further comprising an opening/closing member that opens or closes the opening.

12. The sheet container according to claim 1, wherein the connection member comprises a raising member that raises the extension part relative to the stacking part, and wherein the retreater retreats the contact part in the attached state to a raising space defined by the raising member.

13. A sheet feeder, comprising:

the sheet container according to claim 1; and a transporter that transports the recording sheets on the stacking part away from the contact part.

14. An image forming system, comprising:

an image forming apparatus that forms images on recording sheets; and the sheet feeder according to claim 13 that transports the recording sheets to the image forming apparatus.

15. An image forming system, comprising:

an image forming apparatus that forms images on recording sheets; and the sheet container according to claim 1 that contains the recording sheets output from the image forming apparatus by stacking the recording sheets on the stacking part.

16. A sheet container, comprising:

a housing;

a stacking part provided in the housing so that recording sheets are stacked on the stacking part;

a contact part to be brought into contact with edges of the recording sheets in a length direction on the stacking part in an attached state in which the contact part is attached into the housing;

a connector provided to the stacking part or the housing so that a connection member is connected to the connector in a removable manner, the connection member having an extension part longer than the stacking part in the length direction; and a retreater that retreats the contact part in the attached state from the extension part when the connection member is connected to the connector.

17. A sheet container, comprising:

a housing;

a stacking part provided in the housing so that recording sheets are stacked on the stacking part;

a contact part to be brought into contact with edges of the recording sheets in a length direction on the stacking part in an attached state in which the contact part is attached into the housing;

a receptacle provided to the stacking part or the housing so that a raising member is attached to the receptacle in a removable manner, the raising member being configured to raise a stacking position of the recording sheets; and a retreater that retreats the contact part in the attached state to a space below the raised stacking position when the raising member is attached to the receptacle.

18. The sheet container according to claim 17, further comprising a connector provided to any one of the stacking part, the housing, or the raising member so that a connection member is connected to the connector in a removable manner, the connection member having an extension part longer than the stacking part in the length direction.

19. The sheet container according to claim 18, wherein the connection member and the raising member are integrated together.

* * * * *